United States Patent [19]

Reba et al.

[11] Patent Number: 4,597,573

[45] Date of Patent: Jul. 1, 1986

[54] SYSTEM FOR HANDLING DISCRETE SHEETS

[75] Inventors: Imants Reba, Vancouver, Wash.; Rodney E. Pollock, Portland, Oreg.

[73] Assignee: Crown Zellerbach Corporation, San Francisco, Calif.

[21] Appl. No.: 699,277

[22] Filed: Feb. 7, 1985

[51] Int. Cl.[4] ..... B65H 29/24

[52] U.S. Cl. ..... 271/195; 271/3.1; 271/97

[58] Field of Search ..... 271/195, 98, 97, 3.1, 271/202, 203, 182, 183, 37

[56] References Cited

U.S. PATENT DOCUMENTS

| | | | |
|---|---|---|---|
| 3,032,340 | 5/1962 | Lawrence | 271/182 |
| 3,880,297 | 4/1975 | Martin | 271/195 |
| 3,905,490 | 10/1975 | Johnson | 271/3.1 |
| 3,942,786 | 3/1976 | Lauren | 271/202 X |

FOREIGN PATENT DOCUMENTS

| | | | |
|---|---|---|---|
| 0061544 | 5/1980 | Japan | 271/97 |

*Primary Examiner*—Bruce H. Stoner, Jr.
*Assistant Examiner*—Matthew C. Graham
*Attorney, Agent, or Firm*—Thomas R. Lampe

[57] ABSTRACT

A system for handling discrete sheets including a nozzle for simultaneously lifting the sheet from a surface by suction and propelling the sheet in a direction generally corresponding to the plane of the sheet.

21 Claims, 5 Drawing Figures

SYSTEM FOR HANDLING DISCRETE SHEETS

BACKGROUND OF THE INVENTION

1. Field of the Invention

This invention relates to an apparatus and method for handling discrete relatively rigid or stiff sheets, and more particularly, to a system for conveying the sheets in a direction generally corresponding to the planes thereof while simultaneously applying suction forces to the sheets in a direction substantially normal to the planes thereof to lift the sheets away from a support surface.

2. Description of the Prior Art

The present invention has application to any operating environment wherein it is desired to serially convey discrete relatively rigid or stiff sheets quickly and in such a manner as to minimize physical contact between the sheet and a support surface. By minimizing frictional effects between the sheets and a support surface, the sheets may be fed at a faster rate than is possible with prior art systems. Further, removal of the conveyed sheet from a table or other support minimizes the possibility of jam-ups.

The most common form of sheet conveyors are mechanical systems, employing, for example, rope or belt conveyors to transport the sheets. Such mechanical conveyors, however, have a number of drawbacks. Not only are such mechanical arrangements subject to wear, they are also very limited as to performance. If operated at high production rates, the rope or belt conveyors often cannot maintain accuracy of sheet placement. Such mechanical arrangements are characterized by frictional forces being applied to the sheets during operation which, as stated above, provides limitations upon the rate of conveyance.

While air tables and similar arrangements are known and widely used in the conveying art, such prior art devices, which rely on a positive air pressure between the conveyed article and a support surface to operate, have built-in deficiencies. If too great an air pressure is applied to the article during conveyance in an attempt to provide a high degree of clearance between the support surface and the conveyed article, conveyance of the article may actually be interfered with due to a conflict between the propelling gaseous forces and the gaseous forces separating the articles from the support surface. This will result in a slow-down of the conveying process.

U.S. Pat. No. 4,453,709, issued to Imants Reba on June 12, 1984 discloses a system for conveying discrete flexible articles; however, such system is not appropriate for conveying relatively rigid or stiff articles, such as, for example, place mats.

BRIEF SUMMARY OF THE INVENTION

According to the present invention, discrete sheets having planar surfaces are conveyed relative to a support surface. In contrast to prior art arrangements, however, such sheets are lifted away from the support surface by exerting suction forces thereon on the side of the sheet removed from the support surface.

The suction force on the sheets is created by producing a first gaseous flow due to the Coanda effect from nozzle means disposed adjacent to the side of the sheet opposed to the support surface. This creates a suction lifting force in a direction substantially normal to the planar surfaces of the sheet. The nozzle means is further operable to produce a second gaseous flow exerting a propelling force on the sheet in a direction substantially corresponding to the plane of the sheet planar surfaces.

Because the first gaseous flow is directed away from the passageway in which the sheet is to be conveyed, it will not interfere with the gaseous propelling forces used to convey the sheet through the passageway. Other and additional operational details of the system of the present invention are set forth below.

DETAILED DESCRIPTION

Figure 1:
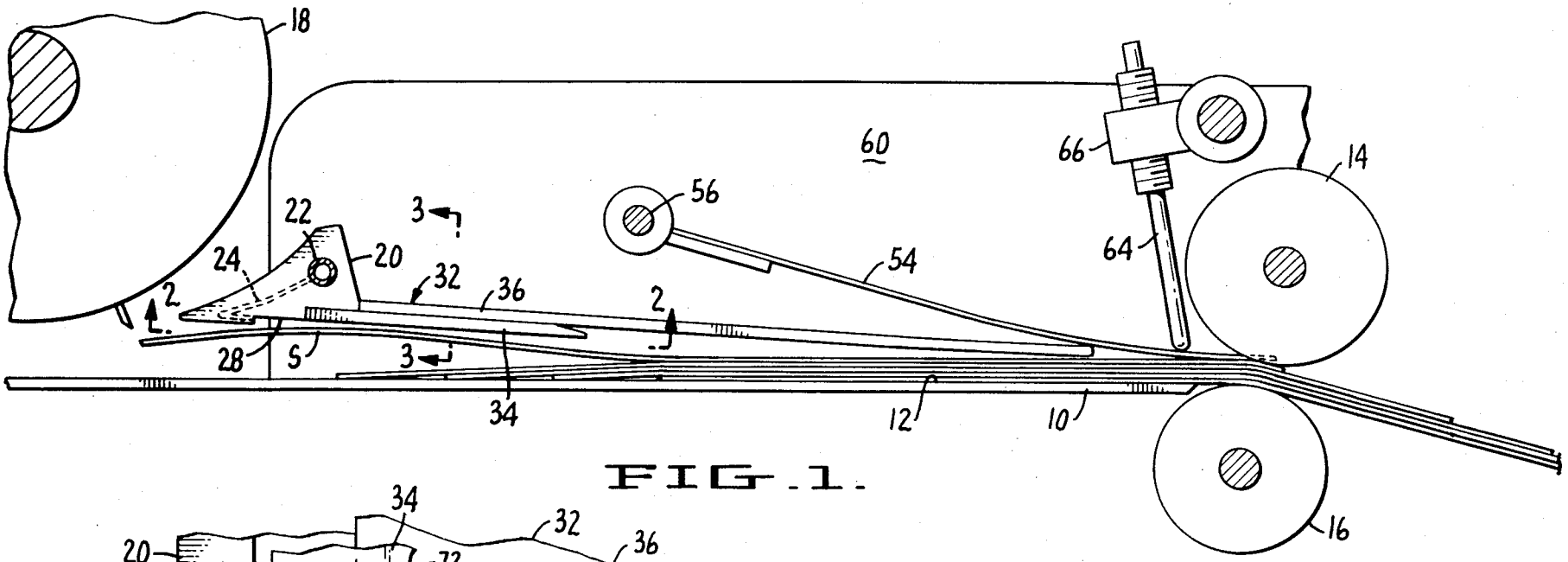
FIG. 1 is a schematic side view of a preferred form of apparatus constructed in accordance with the teachings of the present invention.
Figure 3:
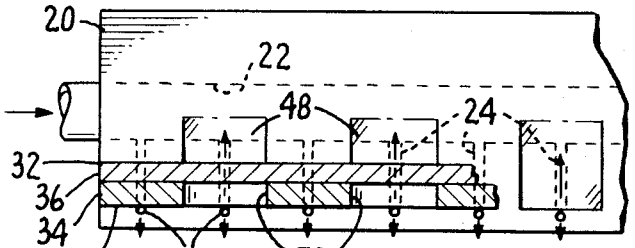
FIG. 3 is a partial sectional view taken along the line 3—3 in FIG. 1.
Figure 2:
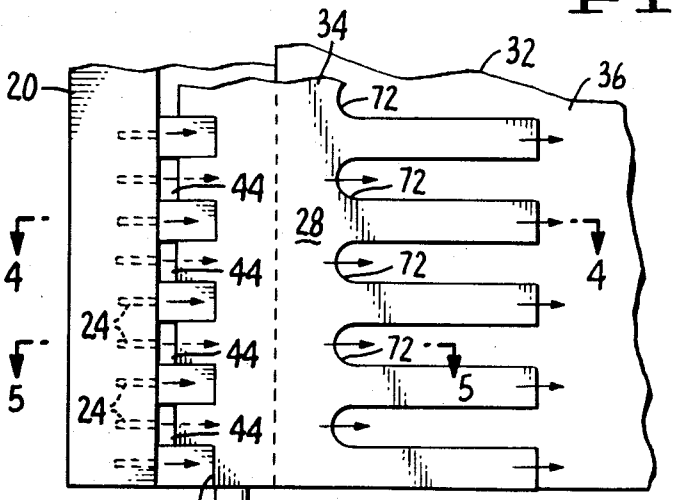
FIG. 2 is a partial sectional view taken along the line 2—2 in FIG. 1.

Referring now to the drawings, a preferred embodiment of the present invention is illustrated. The apparatus includes a support plate 10 defining an upper support surface 12. The support plate 10 extends between a source of discrete sheets and pulling means in the form of rotating rolls 14, 16 forming a nip therebetween. The source of discrete sheets in the illustrated embodiment is a rotary blade device 18 which is adapted to sever the sheets from a parent web (not shown) in a well-known manner. The rotary blade device 18, being of any suitable well-known construction, is illustrated in schematic form and is adapted to rotate in a counterclockwise direction as seen in FIG. 1. In that figure, a sheet S is shown after it has been severed from its parent roll by the blade device 18.

Disposed above support surface 12, spaced therefrom, and disposed closely adjacent to the source of sheet S, is a nozzle 20 having a principal axis extending across support plate 10 as illustrated. As may be seen with particular reference to FIGS. 4 and 5, nozzle 20 includes a closed-ended air chamber or reservoir 22 which extends along the principal axis of the nozzle. The reservoir 22 is in fluid-flow communication with a suitable source of compressed air (not shown).

A plurality of spaced air flow outlets 24 are formed in the nozzle body and are in communication with air reservoir 22. The outlets 24, when the reservoir is pressurized, direct air toward an air flow surface 28 leading from the nozzle.

The air flow surface 28 is defined by plate means 32 including a first plate segment 34 defining a first portion of the air flow surface and a second plate segment 36 defining a second portion of the air flow surface. The first plate segment 34 is the segment most closely adjacent to the nozzle and the first portion of the air flow surface is in general alignment with the air flow outlets 24 in the direction of air flow exiting therefrom. Plate means 32 and support plate 10 form a passageway therebetween through which air flow from outlets 24 passes.

The cross-section of nozzle 20 and of first plate segment 34 changes in configuration segmentally over the length thereof. Specifically, in the portions of the nozzle and first plate segment having the configuration shown in FIG. 5, the nozzle and first plate segment are so configured as to provide a gap 44 therebetween. In the portions having the configuration shown in FIG. 4, on the other hand, the air flow surface 28 forms a continuous extension of the nozzle and the first plate segment 34 is directly connected thereto so that no gap exists. In the FIG. 5 configuration, the gap 44 leads to a narrow opening 46 formed between the nozzle and the first plate segment. The nozzle has a flow attachment surface 48 leading upwardly away from opening 46. The surface 48 deviates at a small angle, as shown, from the direction of the opening.

The aforedescribed structure of the nozzle and the first plate segment results in the formation of first and second gaseous flows. The first gaseous flow is that created as a result of a certain portion of the air flow passing through outlets 24, entering gaps 44, and proceeding upwardly through openings 46. The configuration shown in FIG. 5, results in the Coanda effect coming into play. The air passing through gap 44 and restricted opening 46 will attach to flow attachment surface 48 due to the Coanda effect. The diverted air flow from outlets 24 and any ambient air entrained thereby will thus be vented upwardly and out of the passageway defined by support plate 10 and plate means 32. This will create an upwardly directed air flow which will produce a suction force on sheet S in the vicinity of gaps 44 in a direction substantially normal to the planar surfaces of the sheet to lift the sheet from the support surface.

Figure 4:
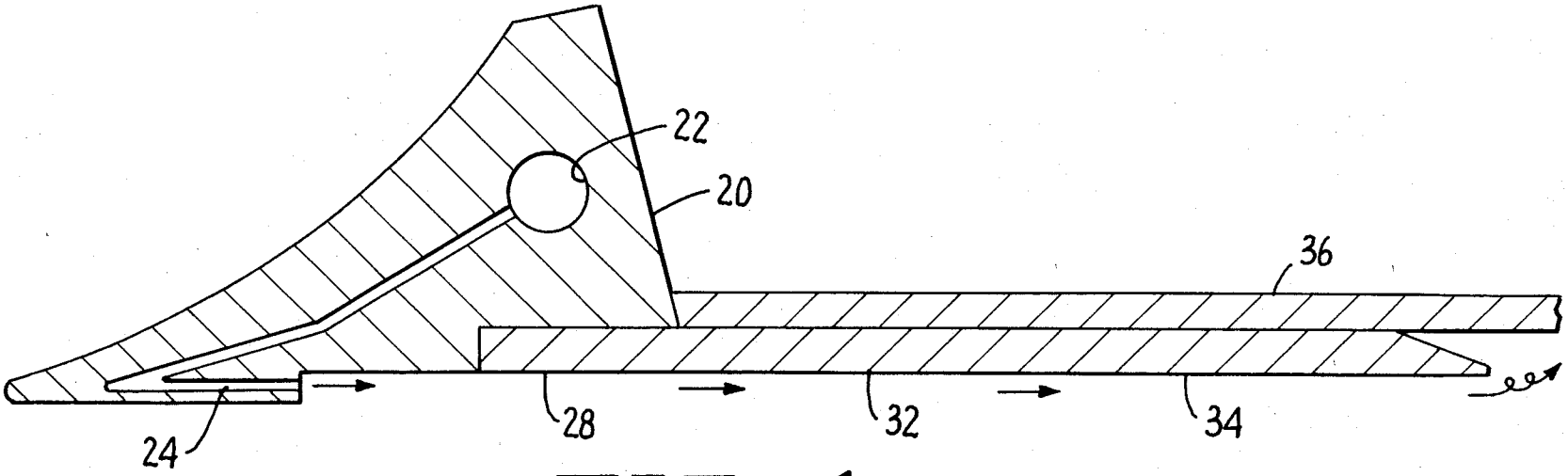
FIG. 4 is an enlarged sectional view taken along the line 4—4 in FIG. 2.
Figure 5:
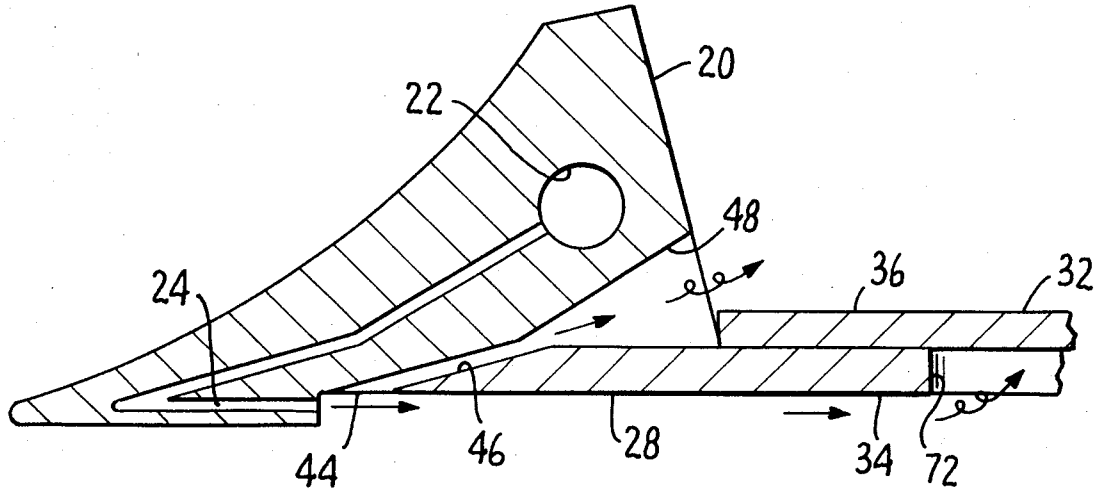
FIG. 5 is an enlarged sectional view taken along the line 5—5 in FIG. 2.

The second gaseous flow produced by the aforedescribed arrangement is that which flows along air flow surface 28. In the configuration of FIG. 4, this will be all of the flow generated by the nozzle in that particular cross-sectional portion. With regard to the FIG. 5 configuration, air flow along air flow surface 28 will include the air exiting from outlet 24 not diverted through gap 44 and opening 46. The second gaseous flow exerts a propelling force on sheet S in a direction substantially corresponding to the plane of the sheet planar surfaces, i.e. in the passageway to the right as viewed in FIG. 1.

The sheets S, which are serially transported in the passageway, have their movement interrupted by spring members 54 which define a restricted opening with support surface 12 in communication with the passageway. The support surface and the spring members cooperate to shingle the sheets as the sheets are stacked one by one on top of one another due to the previously described gaseous flow. The spring members are of identical construction and, being spaced from one another, are engageable with the sheets at spaced locations thereon. More particularly, the spring members 54 are in the form of flat plates constructed of a suitable material such as spring steel. The spring members are rotatably mounted at one end thereof on a shaft 56 extending between frame walls 60 disposed on either side of support plate 10 and extending upwardly therefrom.

Means is provided for adjusting the pressure of each spring member on sheets S. In the preferred illustrated embodiment such adjustment means comprises a threaded adjustment screw 64 threadably engaged in a screw mount 66 and selectively manually adjusted relative thereto.

The aforesaid arrangement operates as follows. The nozzle 20 is pressurized. This creates a flow of air in the passageway between support plate 10 and plate means 32 which will cause entrainment of sheets S exiting seriatim from the rotary blade device location.

Due to the suction created at gaps 44, each sheet will be raised in the vicinity thereof away from support plate 10, i.e. due to the first gaseous flow. The second gaseous flow continues to exert a propelling force on the sheets in a direction substantially corresponding to the plane of the sheet planar surfaces.

Movement of the sheets is interrupted by engagement with the spring members 54. The sheets will become stacked and shingled as shown in FIG. 1 due to the interaction of the spring members and the support plate 10, followed by the engagement between nip rolls 14 and 16 and the leading edge of the sheet being carried to this point due to the urging of the gaseous propelling force. Each sheet in turn there so introduced by the gaseous flow and engaged by the nip rolls passes therethrough to a desired downstream location. By adjusting the pressures that the tips of the spring members exert on the exiting sheet, it can be steered and/or slowed down, thus providing more accurate control. The downstream destination is not particularly pertinant to the present invention, but, for illustration purposes, the aforedescribed device has been used to convey sheets to a stacking tray.

The plate means 32 incorporates certain features which contributes to the functioning of the apparatus. First, it should be noted that notches 72 are formed in first plate segment 34. The notches help to minimize any possible physical contact area between the sheet and the plate means. Further, the second plate segment is mounted above the notched first plate segment. That is, the second plate segment is attached to the first plate segment and offset therefrom so that the second portion of the air flow surface is offset from the first portion of the air flow surface and further removed from the support surface than the first portion. It has been found that the step or offset thus created between the two plate segments assists in the release of the sheet from the plate means. It also minimizes the possibility of sheet leading edge foldover; hence, jam-ups.

The apparatus as shown in the disclosed embodiment of the invention has been employed as an intermediate stage between the cutting of paper placemats from a parent roll and the stacking thereof. It should, however, be appreciated that the apparatus and method of the invention may be utilized to handle discrete sheets of various types, as long as the sheets are sufficiently rigid that they do not require application of lateral stretch forces to maintain the sheets in a spread condition. Furthermore, the aforedescribed arrangement is properly functional only when the leading edges of the sheets are stiff enough to lift uniformly across the full width thereof as lift forces are applied thereto by the Coanda nozzle means.

For the particular arrangement in actual use in connection with paper placemats, the outlets 24 had a diameter of 1/32 inch and were placed at ½ inch centers. Every other outlet discharges over a horizontal surface creating a propulsive force. The amount of suction is controlled by the amount of vented flow or by the dimensions of gap 44 as presented to the conveyed sheets. Thus, with all other conditions fixed, the ratio of suction and propelling forces is determined by the dimensions of gaps 44. For the placemat application, the width A of gap 44 is in the order of 3/16 inch and the lengthwise dimension ½ inch. It was found that a gap width dimension greater than ¼ inch was too large, causing the paper sheets to stick. Of course, this condition could be remedied by having higher air flow discharge in the horizontal direction either by having a larger diameter outlet or by more outlets of the same diameter employed to create the second gaseous flow.

Nozzle 20 in the illustrative embodiment is operated at air supply pressures in the range of from about 15 to about 25 psig. Desirably, air flow surface 28 is polytetrafluoroethylene coated for ease of cleaning.

We claim:

1. Apparatus for handling discrete sheets having planar surfaces, said apparatus comprising:

means defining a support surface;

nozzle means spaced from said support surface, said nozzle means defining a plurality of spaced air flow outlets for directing air in a predetermined direction and operable to produce a gaseous flow including first and second gaseous flow components, said first component exerting a suction force on said sheets in a direction substantially normal to the planar surfaces of said sheets to lift said sheets from said support surface, and said second component exerting a propelling force on said sheets in a direction substantially corresponding to the plane of the sheet planar surfaces; and means including plate means extending from said nozzle means defining an air flow surface leading from said nozzle means and forming a passageway with said support surface, said air flow surface adapted to receive said second component and direct said second component away from said nozzle means, said plate means having at least a portion thereof defining an air flow surface portion in general alignment with said air flow outlets in said predetermined direction, said nozzle means and said plate means portion defining a gap therebetween, said nozzle means including a Coanda fluid flow attachment surface leading from said gap away from said predetermined direction whereby some of the air flow exiting from said air flow outlets will be directed away from said predetermined direction due to the Coanda effect and form said first component.

2. The apparatus of claim 1 additionally comprising means for engaging said sheets and interrupting movement of said sheets during propulsion thereof by said second component whereby said sheets accumulate on said support surface at a location removed from said nozzle means.

3. The apparatus of claim 2 wherein said engaging means comprises at least one engagement element defining a restricted opening with said support surface in communication with said passageway, said support surface and said engagement element cooperating to shingle said sheets.

4. The apparatus of claim 3 wherein said engagement element comprises an elongated flat spring member extending toward said support surface and forming an acute angle therewith.

5. The apparatus of claim 4 wherein said engaging means comprises two spring members, said spring members being spaced from one another and engageable with said sheets at spaced locations on said sheets.

6. The apparatus of claim 4 additionally comprising means for adjusting the pressure of said spring member on a sheet passing through said restricted opening.

7. The apparatus of claim 1 wherein said plate means includes a first plate segment defining a first portion of said air flow surface and a second plate segment defining a second portion of said air flow surface.

8. The apparatus of claim 7 wherein said first plate segment has notches formed therein defining a plurality of finger elements extending away from said nozzle means.

9. The apparatus of claim 3 additionally comprising means to pull said shingled sheets seriatim from said support surface.

10. The apparatus of claim 9 wherein said pulling means comprises rotating rolls forming a nip adjacent to said restricted opening and in general alignment with said passageway, said rolls adapted to engage said sheets and propel said sheets through the nip after propulsion of said sheets by said second component.

11. Apparatus for handling sheets comprising:

means defining a support surface and extending between a first location and a second location;

means defining an air flow surface in registry with at least a portion of said support surface defining means and forming a passageway therewith;

nozzle means for producing a flow of air operatively connected to said air flow surface defining means and cooperable therewith to direct a component of said flow of air along said air flow surface through said passageway to propel said discrete sheets from said first location to said second location, and said nozzle means and said air flow surface defining means further cooperable to direct another component of said flow of air in a direction away from said support surface whereby said discrete sheets will be lifted away from said support surface as said sheets are propelled; and Coanda fluid flow attachment surface defining means, said air flow surface defining means and said nozzle means defining a gap therebetween leading to said Coanda fluid flow attachment surface defining means, whereby the Coanda effect is utilized to direct said another component of said flow of air away from said support surface.

12. A method for handling discrete sheets having planar surfaces, said apparatus comprising the steps of:

providing a support surface adjacent to a source of discrete sheets;

supplying discrete sheets seriatim from said source to said support surface;

at a location spaced from said support surface, producing a gaseous flow, having first and second components, from a nozzle means adjacent a plate means;

utilizing the Coanda effect to create a suction force with said first component in a direction substantially normal to the planar surfaces of said sheets to lift said sheets from the support surface by directing the first component into a gap between the nozzle means and the plate means;

using said second component to exert a propelling force on said sheets in a direction substantially corresponding to the plane of the sheet planar surfaces; and propelling said sheets with said propelling force while lifting said sheets through use of said suction force.

13. The method of claim 12 additionally comprising the step of providing an air flow surface at a location spaced from said support surface to form a passageway therebetween and wherein the sheets are propelled in said passageway.

14. The method of claim 13 comprising the additional step of interrupting movement of said sheets to accumulate said sheets on said support surface.

15. The method of claim 14 wherein the step of interrupting movement of said sheets is accomplished by engaging said sheets with at least one engagement element defining a restricted opening with said support surface in communication with said passageway.

16. The method of claim 15 including the additional step of shingling said sheets through engagement of said sheets with said engagement element.

17. The method of claim 16 including the step of yieldably engaging said sheets with said engagement element.

18. The method of claim 17 including the step of positioning said engagement element to form an acute angle with said support surface.

19. The method of claim 18 including the step of positioning a plurality of engagement elements to engage said sheets.

20. The method of claim 19 including the step of adjusting the tension of said engagement elements relative to said sheets to affect the movement of said sheets.

21. The method of claim 20 including the step of offsetting a portion of said air flow surface relative to another portion of said air flow surface to assist in the release of said sheet from said system.

* * * * *